US006497554B2

(12) United States Patent
Yang et al.

(10) Patent No.: US 6,497,554 B2
(45) Date of Patent: Dec. 24, 2002

(54) FAIL SAFE ELECTRONIC PRESSURE SWITCH FOR COMPRESSOR MOTOR

(75) Inventors: George Yang, Fort Wayne, IN (US); Michael Branson, Noblesville, IN (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/742,991

(22) Filed: Dec. 20, 2000

(65) Prior Publication Data

US 2002/0076332 A1 Jun. 20, 2002

(51) Int. Cl.[7] ..... F04B 49/06
(52) U.S. Cl. ..... 417/44.2; 417/902; 418/55.1
(58) Field of Search ..... 417/44.2, 902; 418/55.1, 55.5, 83; 62/228.3

(56) References Cited

U.S. PATENT DOCUMENTS 4,527,953 A * 7/1985 Baker et al. ..... 417/38
4,538,422 A * 9/1985 Mount et al. ..... 62/201
4,863,355 A * 9/1989 Odagiri et al. ..... 417/12
5,321,957 A * 6/1994 Moore ..... 62/228.3

FOREIGN PATENT DOCUMENTS

JP 8-313123 * 11/1996

* cited by examiner

*Primary Examiner*—Charles G. Freay
*Assistant Examiner*—Michael K. Gray
(74) *Attorney, Agent, or Firm*—Carlson, Gaskey & Olds

(57) ABSTRACT

An electronic pressure sensor is incorporated into a discharge pressure portion of a compressor. If the pressure sensor indicates that the discharge pressure exceeds a maximum value, the operation of the compressor motor is stopped. The pressure sensor preferably sends an electronic signal to a microprocessor such that the pressure can be compared to a predetermined maximum value. The pressure sensor includes a transducer to change the sensed pressure to a voltage value. The microprocessor communicates with a first switch, which may be a triac switch, and which stops operation of the compressor motor should an undesirably high value be detected. In addition, a second switch communicates with a comparing circuit which ensures the voltage from the pressure sensor is between a minimum and maximum value. The purpose of the comparing circuit is to ensure proper operation of the pressure sensor and its associated circuit.

7 Claims, 1 Drawing Sheet

FAIL SAFE ELECTRONIC PRESSURE SWITCH FOR COMPRESSOR MOTOR

BACKGROUND OF THE INVENTION

This invention relates to an electronic switch for stopping operation of a compressor motor if certain pressure conditions are not met.

Compressors are typically driven by an electric motor to compress a fluid, such as a refrigerant, and move that fluid to a downstream use. In a refrigerant compressor, typically, the compressed refrigerant is sent into a refrigerant cycle.

In a refrigerant compressor, there are many potential concerns that can arise. As one example, the refrigerant can be over pressured due to a number of conditions. For that reason, pressure sensors have typically been incorporated somewhere adjacent the discharge portion of the compressor to monitor the discharge pressure. If the discharge pressure exceeds a predetermined amount, then the compressor motor may be stopped. Typically, these pressure sensors have included mechanical elements that move against a spring force, etc., to open a cutoff switch.

While a mechanical switch is relatively inexpensive, it is not as reliable as would be desired. Thus, a more reliable safety switch with fail-safe features would be desirable.

SUMMARY OF THE INVENTION

In the disclosed embodiment of this invention, a pressure sensor communicates with an electronic control to send a signal to a switch to stop operation of a compressor motor should a sensed pressure be outside an acceptable range. Most preferably, the pressure sensor is sensing a discharge pressure, and the condition which is outside the acceptable range would typically be an overly high discharge pressure.

In the disclosed embodiment, a microprocessor based control receives a voltage signal from a pressure sensor which is related to the compressor discharge pressure. A transducer is typically included into the electronic pressure sensor such that the pressure is transferred into a related voltage amount. The voltage amount is sensed by the microprocessor based control. If the voltage amounts indicates that the pressure exceeds a particular predetermined high pressure, then a signal is sent to a first switch to stop operation of the compressor. Most preferably the compressor is stopped by opening a relay which is part of the compressor motor control.

Such a system provides benefits when compared to the prior art. However, with such an electronically controlled system it would still be desirable to include a fail-safe mode to ensure proper operation of the electronic control. Thus, in a most preferred embodiment, the signal from the pressure sensor, which is preferably a voltage signal, is sent to a comparing circuit. The comparing circuit sends a signal to a second switch. If the comparing circuit senses that the pressure voltage signal is less than, or more than, predetermined boundaries, then the relay is left open. The compressor motor is again stopped from operating. In this way, should the microprocessor or pressure sensor fail, this fail-safe portion of the circuit will stop operation of the motor.

In a preferred embodiment, the first switch, which communicates with the microprocessor based control is a triac. The second switch is preferably an output relay. The second switch relay is preferably in series with the triac, and is controlled by the comparing circuit. The comparing circuit is preferably a bandwidth comparing circuit.

These and other features of the present invention can be best understood from the following specification and drawings, the following of which is a brief description.

BRIEF DESCRIPTION OF THE DRAWINGS

The sole FIGURE is a schematic view of a circuit for controlling a compressor motor.

DETAILED DESCRIPTION OF A PREFERRED EMBODIMENT

Figure 1:
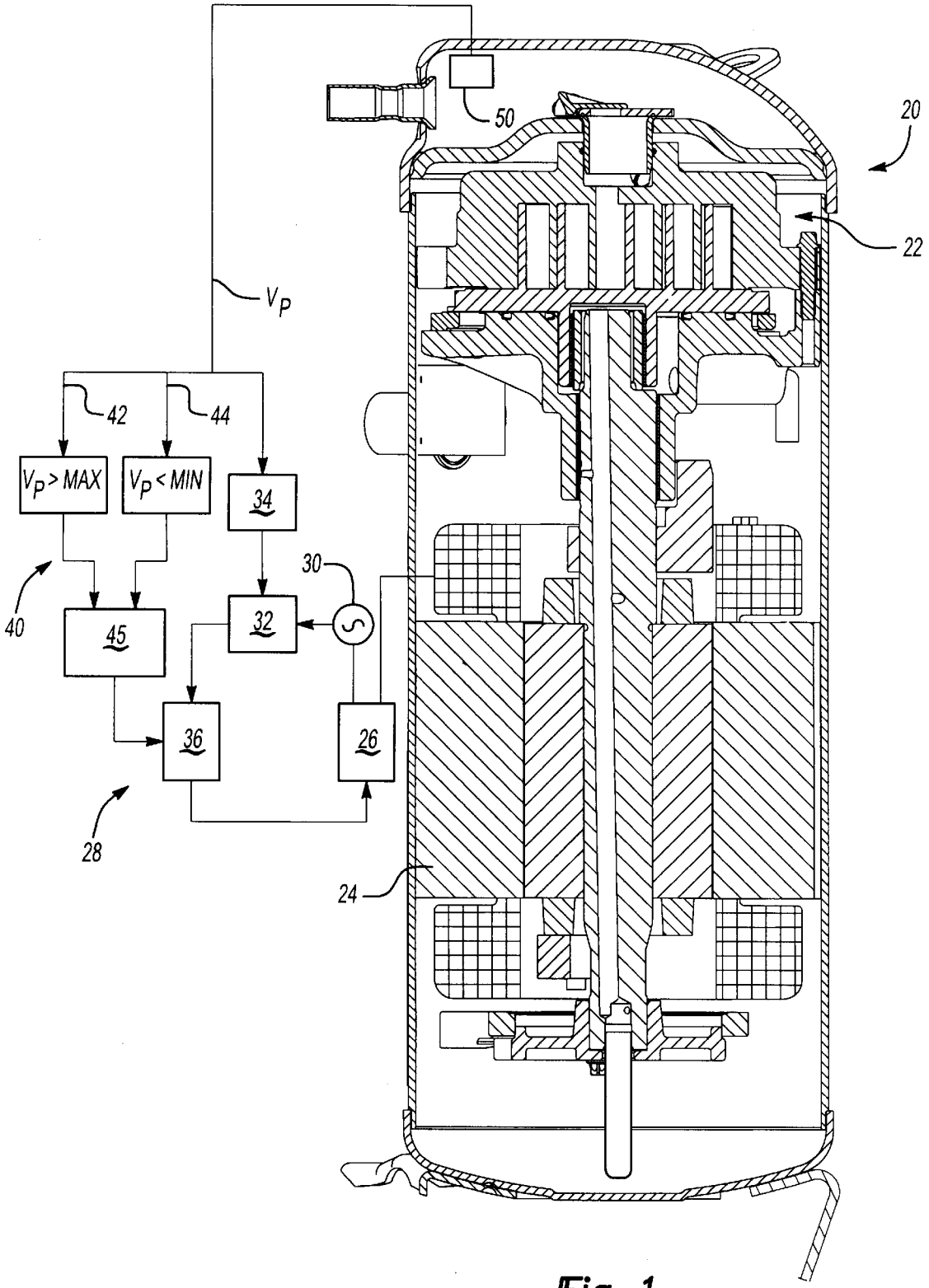

As shown in FIG. 1 a compressor 20 includes a pump unit 22 driven by a motor 24. A motor relay 26 may be deactivated to stop operation of the compressor motor 24 through a safety circuit 28. The pump unit 22 is shown as a scroll compressor, but this invention extends to any type of compressor. In a disclosed embodiment a AC power source 30 is part of the circuit 28 and supplies power to a first switch 32. The first switch 32 is preferably a triac receiving an input from AC power source 30, and a second input from a microprocessor 34, as will be described below. The output of the triac extends to a second switch 36. The switch 36 is preferably a relay which communicates power to the motor relay 26. As shown, a comparing circuit 40 receives two inputs 42 and 44. The input 42 compares a voltage from a pressure sensor $V_p$ to the max value. If the $V_p$ exceeds the V max value then a signal is sent to an OR gate 45. The second input 44 of the circuit compares to $V_p$ to a minimum value. If the $V_p$ value is less than the V minimum, then a second signal is sent to the OR gate 45. If the output of the gate 45 is that either 42 or 44 indicates a problem, then the relay switch 36 opens the relay 24. The effect of the combined circuit 40 is to ensure that the $V_p$ is at least equal to a minimum value, and is less than a maximum value.

The $V_p$ value is sent also to the microprocessor 34. In the microprocessor 34, the $V_p$ value is compared to system condition, and a signal is sent to the triac 26 if the $V_p$ value exceeds a predetermined maximum. The predetermined maximum by the microprocessor is typically less than the V max value. The portion 40 of the circuit is intended as a fail-safe component to ensure that the pressure sensor 50 and the microprocessor based control are operating properly. If the $V_p$ value is not within the range of the comparing circuit 40, and yet the microprocessor has not stopped operation of the motor through the triac 28, there is some indication that either the pressure sensor 50 or the microprocessor control itself have failed. Thus, the comparing circuit 40 will operate to stop the compressor.

The pressure sensor 50 may be as known, and is shown on a discharge pressure of the compressor pump unit 22. Typically, the pressure sensor senses the pressure and transforms that pressure into a voltage which is relative to the pressure.

The present invention discloses a low cost effective fail-safe design for incorporating electronic controls into a compressor pressure sensor. A worker of ordinary skill in the art would recognize how to provide the particular software and hardware. It is not the design of any one component which is inventive here, but rather the combination of the components to achieve the benefits as set forth in the following claims which is inventive. Moreover, a worker in this art would recognize that there would be many modifications within the scope of this invention. For that reason, the following claims should be studied to determine the true scope and content of this invention.

What is claimed is:

1. A compressor comprising:

a pump unit;

an electric motor for driving said pump unit; and a switching circuit for stopping operation of said motor, said switching circuit receiving an electric signal from a pressure sensor, said electric signal being operable to stop operation of said compressor motor should a pressure signal be indicative of a pressure higher than a preset maximum.

2. A compressor as set forth in claim 1, wherein said switching circuit includes a first switch receiving a signal from a microprocessor that evaluates said electric signal, said first switch opening should said electric signal be indicative of an unduly high pressure.

3. A compressor as set forth in claim 2, wherein a comparing circuit monitors a voltage from said electric signal to ensure that said electric signal is indicative of proper operation of said circuit, and said comparing circuit being operable to open a switch and stop operation of said compressor motor in the event that said voltage from said pressure sensor is indicative of a problem in said system.

4. A compressor as recited in claim 3, wherein said comparing circuit includes both a maximum and a minimum value for said electric signal, and if either of said minimum or said maximum values are crossed, said comparing circuit stops operation of said compressor motor.

5. A compressor as recited in claim 3, wherein said switch communicating with said comparing circuit is a second switch.

6. A compressor as recited in claim 2, wherein said first switch is a triac switch.

7. A compressor comprising:

a pump unit;

an electric motor for driving said pump unit; and a switching circuit for stopping operation of said motor, said switching circuit receiving an electric signal from a pressure sensor, said electric signal be operable to stop operation of said compressor motor should a pressure signal be indicative of a pressure higher than a preset maximum, said switching circuit including a first triac switch receiving a signal from a microprocessor, said microprocessor receiving said electric signal, said microprocessor comparing said electric signal to a maximum signal, said microprocessor sending a signal to open said triac switch should said electric signal be indicative of an unduly high pressure, and a comparing circuit being incorporated into said switching circuit, said comparing circuit comparing said electric signal to stop operation of said compressor motor if said electric signal is outside of one of said minimum and maximum voltages.

* * * * *